United States Patent [19]

Hamai et al.

[11] Patent Number: 4,457,285

[45] Date of Patent: Jul. 3, 1984

[54] SUSTAINED ARC IGNITION SYSTEM FOR AN INTERNAL COMBUSTION ENGINE

[75] Inventors: Kugo Hamai, Yokosuka; Yosuhiko Nakagawa, Kamakura; Meroji Nakai, Yokosuka; Junichi Furukawa; Takashi Ishizuka, both of Yokohama, all of Japan

[73] Assignee: Nissan Motor Company, Ltd., Yokohama, Japan

[21] Appl. No.: 442,906

[22] Filed: Nov. 19, 1982

[30] Foreign Application Priority Data

Nov. 24, 1981 [JP] Japan ..... 56-186842

[51] Int. Cl.[3] ..... F02P 3/02; F02P 1/00

[52] U.S. Cl. ..... 123/598; 123/605

[58] Field of Search ..... 123/598, 605, 607

[56] References Cited

U.S. PATENT DOCUMENTS

| | | | |
|---|---|---|---|
| 3,502,955 | 3/1970 | Minks | 123/598 |
| 3,704,699 | 12/1972 | Howard | 123/598 |
| 3,750,637 | 8/1973 | Minks | 123/598 |
| 3,832,986 | 9/1974 | Dogadko | 123/598 |
| 3,837,326 | 9/1974 | Kamiji | 123/598 |
| 3,847,129 | 11/1974 | Canup | 123/598 |
| 3,898,971 | 8/1975 | LeFevre | 123/598 |
| 3,903,861 | 9/1975 | DiCeceo et al. | 123/598 |
| 3,961,617 | 6/1976 | Satake | 123/598 |
| 4,369,758 | 1/1983 | Endo | 123/605 |

FOREIGN PATENT DOCUMENTS

| | | | |
|---|---|---|---|
| 2252193 | 3/1973 | Fed. Rep. of Germany | 123/607 |
| 2324784 | 7/1974 | Fed. Rep. of Germany | 123/598 |
| 652 | 2/1979 | United Kingdom | 123/598 |
| 2105404 | 3/1983 | United Kingdom | 123/598 |

*Primary Examiner*—Raymond A. Nelli

*Attorney, Agent, or Firm*—Schwartz, Jeffery, Schwaab, Mack, Blumenthal & Koch

[57] ABSTRACT

An internal combustion engine ignition system comprises: (a) a capacitive discharge ignition device having a voltage transformer which converts a low DC voltage into a corresponding AC voltage and boosts and rectifies the AC voltage into a first higher DC voltage for discharging each of the spark plugs sequentially, boosts and rectifies the AC voltage into a second higher DC voltage for generating arc-sustaining ignition energy, and rectifies the AC voltage into a third higher DC voltage; (b) an ignition signal generating means which generates and outputs an ignition signal whenever the engine rotates through a predetermined engine rotational angle offset by an angular interval determined by the engine speed and engine load; (c) an ignition coil means having a primary winding and secondary winding, one end of the primary winding thereof receiving the first DC voltage from the DC-DC converting means, the other end of the primary winding thereof being grounded when the ignition signal is received from the ignition signal generating means, one end of the secondary winding receiving the second DC voltage from the DC-DC converting means; and (d) a plurality of spark plugs, each located within a corresponding engine cylinder and having a gap between electrodes and one end thereof being connected to the DC-DC converting means for receiving the second and third DC voltages when the ignition signal is received by the ignition coil.

6 Claims, 9 Drawing Figures

TO PREIMARY WINDING 6a OF IGNITION COIL 6
TO SECONDARY WINDING 6b OF IGNITION COIL 6
TO PRIMARY WINDING 6a OF IGNITION COIL 6
FROM MICROCOMPUTER 20
TO MICROCOMPUTER 20
8
$V_A$
$V_B$
200~400V
2~5KV
10~15V
X
ON
START
OFF
$A_{CC}$
1
2
9
10
11
12
13
14
15
16
17

SUSTAINED ARC IGNITION SYSTEM FOR AN INTERNAL COMBUSTION ENGINE

BACKGROUND OF THE INVENTION

Field of the Invention

The present invention relates to a sustained arc ignition system for an internal combustion engine, wherein there are provided an ignition power supply unit having a voltage transformer, a first voltage of a separate secondary winding thereof is applied to a primary winding of an ignition coil means, a second voltage of the separate secondary winding thereof is supplied to a secondary winding of said ignition coil means for storing an ignition energy, a low voltage driven by means of a switching element through an ignition signal for turning on the switching element and a microcomputer for controlling an ignition advance angle according to an engine operating condition.

SUMMARY OF THE INVENTION

It is an object of the present invention to provide an ignition system which is inexpensive and simple in construction, wherein an ignition coil means is provided for generating a breakdown voltage between electrodes of each spark plug and a DC-DC converter serves as means for supplying ignition energy to each spark plug in response to an ignition signal generated at an ignition timing by the DC-DC converter itself.

This can be achieved by providing; (1) a DC-DC converting means having a voltage transformer which converts a low DC voltage into a corresponding AC voltage and boosts and rectifies the AC voltage into a first higher DC voltage for discharging the spark plugs sequentially according to a predetermined ignition order, boosts and rectifies the AC voltage into a second higher DC voltage for generating arc-sustaining ignition energy, and rectifies the AC voltage into a third higher DC voltage; (2) an ignition signal generating means which generates and outputs an ignition signal whenever the engine rotates through a predetermined engine revolutional angle and offset by an interval determined by the engine speed and load; and (3) an ignition coil means, one end of the primary winding of which receives the first DC voltage from the DC-DC converting means, the other end of the primary winding being grounded when the ignition signal is received from the ignition signal generating means, and one end of the secondary winding of which receives the second DC voltage from the DC-DC converting means.

BRIEF DESCRIPTION OF THE DRAWINGS

A more complete understanding of the present invention may be obtained from the following detailed description taken in conjunction with the drawings in which.

DETAILED DESCRIPTION OF THE PREFERRED EMBODIMENTS

Reference will be made to the attached drawings in order to facilitate understanding of the present invention.

Figure 1A:
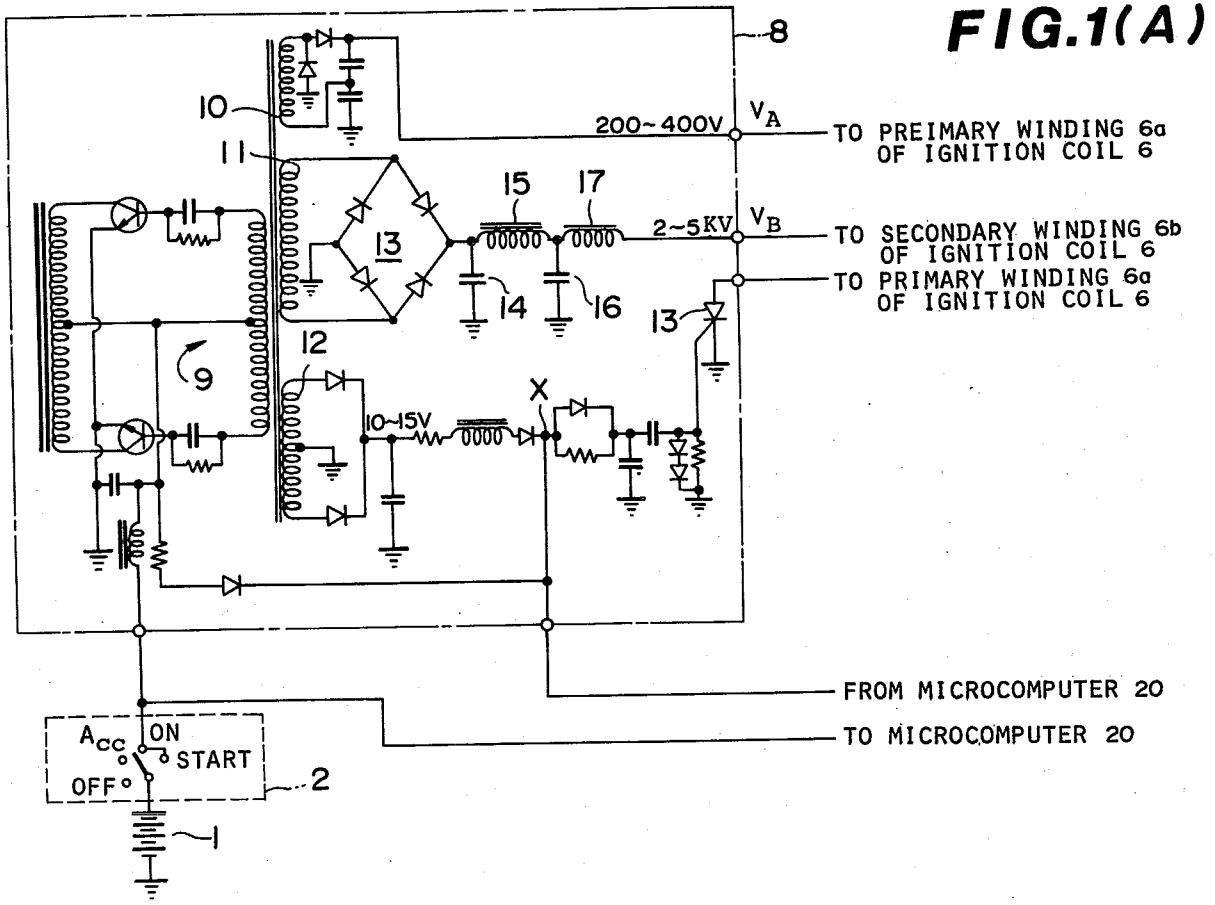
FIGS. 1(A) and 1(B) in combination form a circuit diagram if an ignition system of a first preferred embodiment particularly applicable to a four-cylinder internal combustion engine.
Figure 1B:
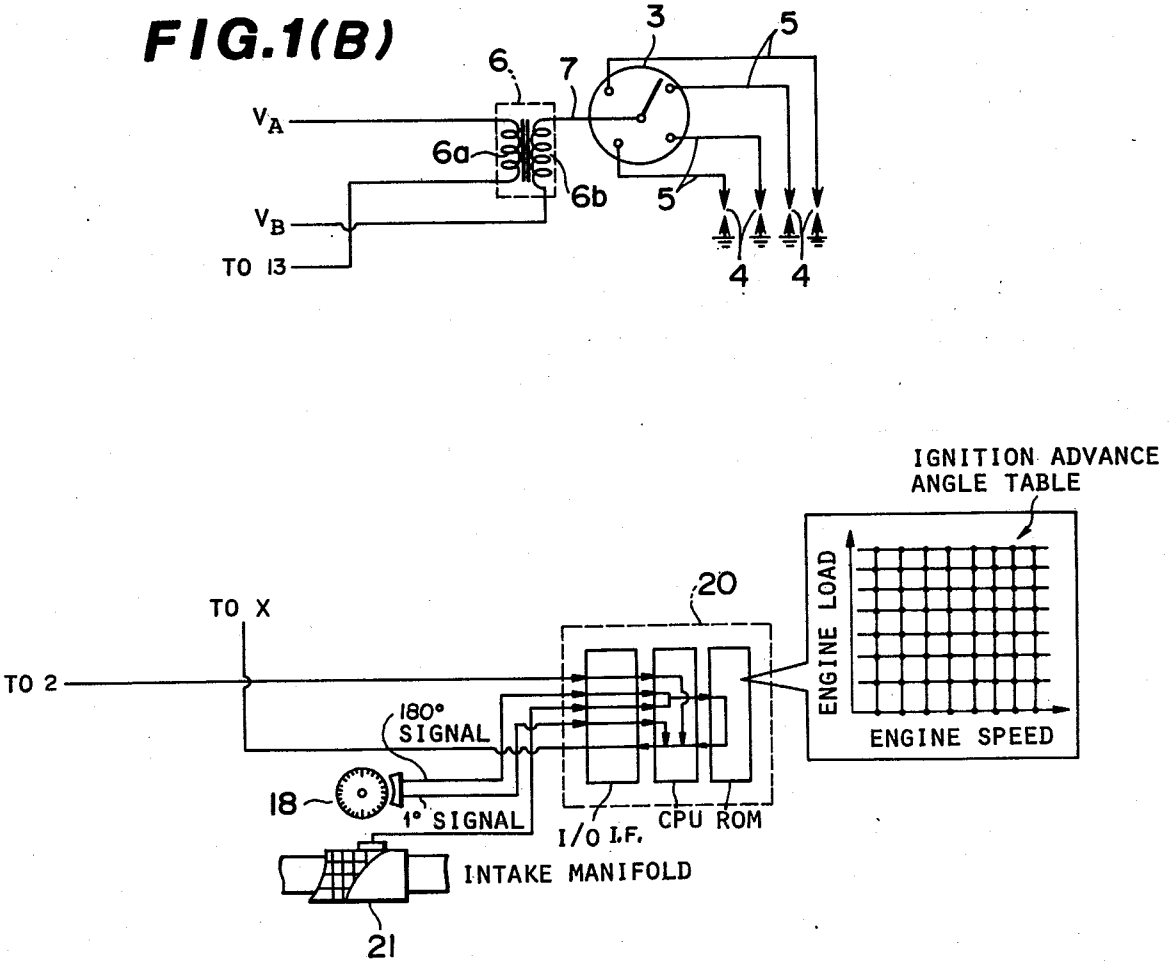

In FIGS. 1(A) and 1(B), numeral 1 denotes a storage battery (DC voltage supply), numeral 2 denotes an ignition key switch, numeral 3 denotes an ignition distributor having a central electrode mounted on a shaft which rotates in synchronization with the engine and a plurality of radially symmetrically arranged stationary outer electrodes, the number of the outer electrodes corresponding to that of engine cylinders, numeral 4 denotes a plurality of spark plugs, each located within a corresponding engine cylinder, numeral 5 denotes high tension cables, each connecting one of the outer electrodes to a corresponding spark plug, and numeral 6 denotes a miniaturized ignition coil having a primary winding **6*a* and secondary winding 6*b*. In addition, numeral 7 denotes a central cable connected between the secondary winding of the miniaturized ignition coil and central electrode of the distributor 3, and numeral 8** denotes a DC-DC-converter-type contactless capacitor discharge ignition device (hereinafter referred simply to as a CDI ignition device).

The CDI ignition device 8 comprises: a voltage boosting transformer having a primary winding 9 constituting an oscillation circuit for converting a low DC voltage from the DC voltage supply 1 via the ignition key switch 2 into a corresponding AC voltage and a first secondary winding 10 connected to the primary winding of the ignition coil 6 for rectifying the AC voltage into a DC voltage of between 200 and 400 volts and outputting the DC voltage to the ignition coil 6, a second secondary winding 11 constituting a high DC voltage converter for rectifying the AC voltage into a high DC voltage of between 2 and 5 kilovolts and outputting the high DC voltage to each of the spark plugs 4 sequentially via the ignition coil 6 and corresponding high tension cable 5, and a third secondary winding 12 constituting a trigger signal generator. The second secondary winding 11 of the CDI device 8 includes a capacitor 14 which stores ignition energy obtained by rectifying the boosted AC voltage through a full-wave rectifier, choke coil 15, discharge capacitor 16, and arc-sustaining coil 17. In the third secondary winding 12 of the CDI device 8, a reverse-blocked triode thyristor 13 (referred hereinafter simply to as thyristor) is provided between the secondary winding **6*b* of the ignition coil 6** and ground.

Furthermore, there are provided a crank angle disk 18 having two large diametrically opposed teeth projecting from the peripheral surface thereof for indicating crank rotation of 180° and a plurality of symmetrically arranged small teeth projecting from the peripheral surface thereof and spaced 4 degrees apart, an ignition signal generator 19 comprising, e.g., two magnetic pick-ups, one for detecting the passage of each of the large teeth on the crank angle disk 14 and generating a pulse signal (180° signal) whose period corresponds to 180° of crankshaft rotation and the other for detecting the passage of each of the small teeth on the crank angle disk 18 and generating another pulse signal (1° signal), the pulse width of which corresponds to 1° of the crankshaft rotation angle, a microcomputer 20 having a memory for storing an ignition advance angle table, and an intake air flow meter 21 as shown in FIG. 1(B) located within an intake manifold of the engine. An "ON" terminal of the ignition key switch 2 is connected to the oscillation circuit of the primary winding in the voltage transformer and to an input/output interface of the microcomputer 20. The output terminals of the ignition signal generator 19 and intake air flow meter 21 are connected to the input/output interface of the microcomputer 20.

The operation of the ignition system shown in FIGS. 1(A) and 1(B) is described hereinbelow. Since a generating voltage $V_A$ of the primary winding 6*a* of the ignition coil 6 ranges from 200 to 400 volts, the winding ratio of the ignition coil 6 need be set to only 1:75 in the case that the breakdown voltage of each spark plug 4 is 30 kilovolts. Consequently, the ignition coil 6 can be miniaturized.

In addition, the generated voltage $V_B$ from the second secondary winding 11 ranges from 2 kilovolts to 5 kilovolts. The generated voltage $V_B$ is stored within the charging and discharging capacitors 14 and 16. The voltage generated by the third secondary winding 12 ranges from 10 to 15 volts. The microcomputer 20 receives the pulses of the 180° and 1° signals from the ignition signal generator 19, retrieves an ignition signal output timing value from the ignition advance angle table, and outputs an ignition start signal to an intermediate terminal of the trigger signal generator in the third secondary winding circuit so as to turn on the thyristor 13 of the CDI ignition device 8. When the thyristor 13 turns on, current flows into the primary winding 6*a* of the ignition coil 6 and accordingly a high surge voltage is generated at the secondary winding 6*b* thereof. Consequently, the high surge voltage is applied across an insulation gap between the electrodes of the corresponding spark plug 4 so as to break down the insulation to enable spark discharge. Immediately after the occurrence of the breakdown, the electrical charge within the discharging capacitor 16 is transmitted across the gap of the corresponding spark plug 4 so as to maintain a sustained arc discharge. It should be noted that if the discharging capacitor 16 is not sufficiently charged because of abrupt increase in the engine speed, the electrical charge within the charging capacitor 14 can be added to that of the discharging capacitor 16 to compensate for insufficient charge.

In this way, ignition energy for effective sustained arc discharge for the combustion of air-fuel mixture supplied to the engine can be provided at every half-rotation of the four-cylinder engine.

In this embodiment, it is preferrable to use a miniaturized ignition coil of a closed-magnetic-circuit-type having high voltage-converting efficiency. The ignition advance angle control is carried out by means of a table look-up technique by the microcomputer 20 on the basis of the output value of the intake air flow meter 21 or an intake negative pressure sensor (not shown) for indicating an engine load and the engine rotational speed calculated from the number of the 1° signals received from the signal generator 19 in a fixed interval of time.

As described hereinabove, in the first preferred embodiment of the ignition system, the CDI ignition device 8 comprises three parts: (a) first secondary winding circuit 10 of the voltage boosting transformer associated with the primary winding 6*a* of the ignition coil 6; (b) second secondary winding circuit 11 of the voltage boosting transformer associated with the secondary winding 6*b* of the ignition coil 6; and (c) third secondary winding circuit 12 of the voltage boosting transformer associated with the primary winding 6*a* of the ignition coil 6.

Figure 2A:
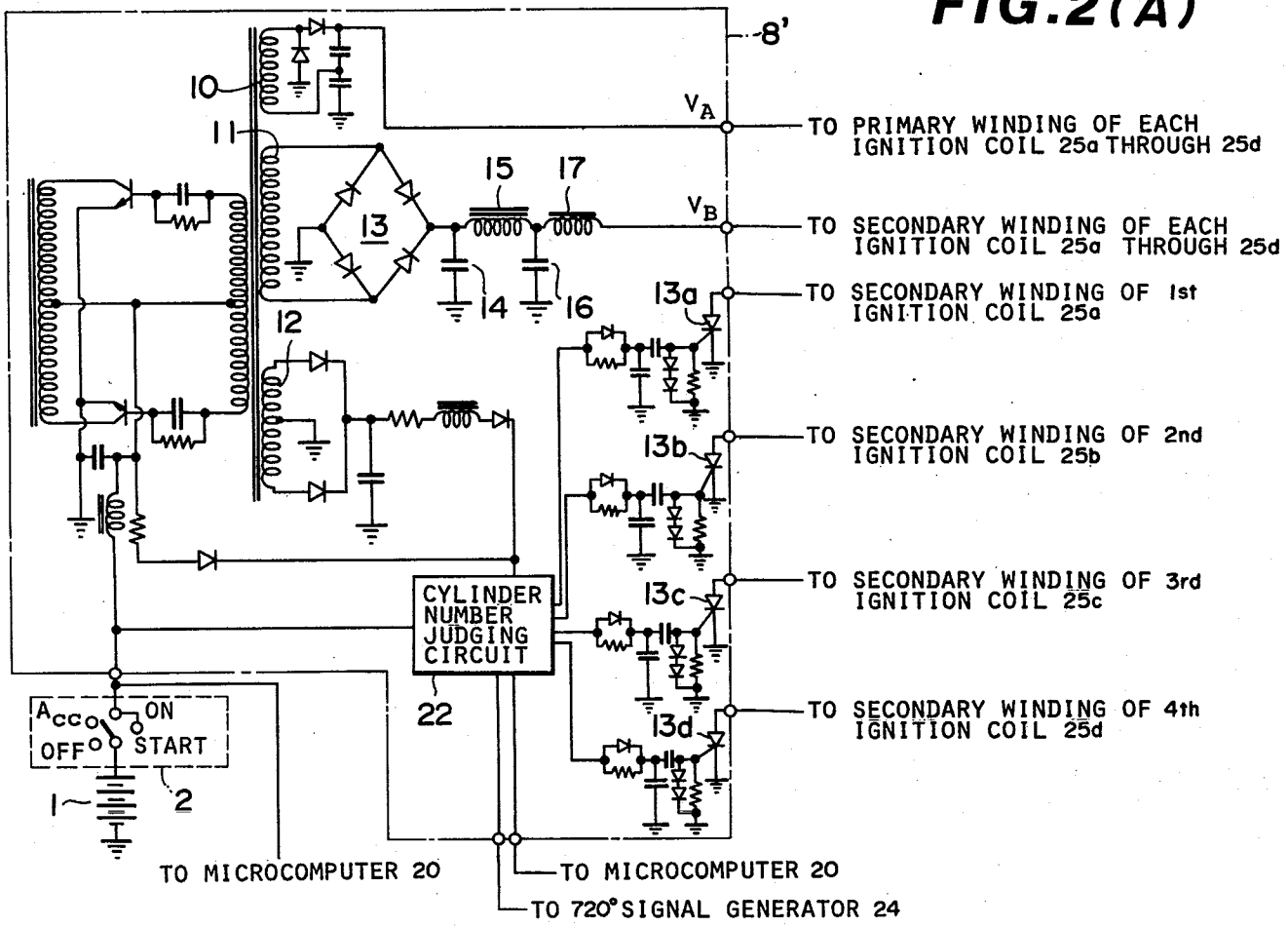
FIGS. 2(A) and 2(B) in combination form a circuit diagram of a second preferred embodiment particularly applicable to a four-cylinder internal combustion engine.
Figure 2B:
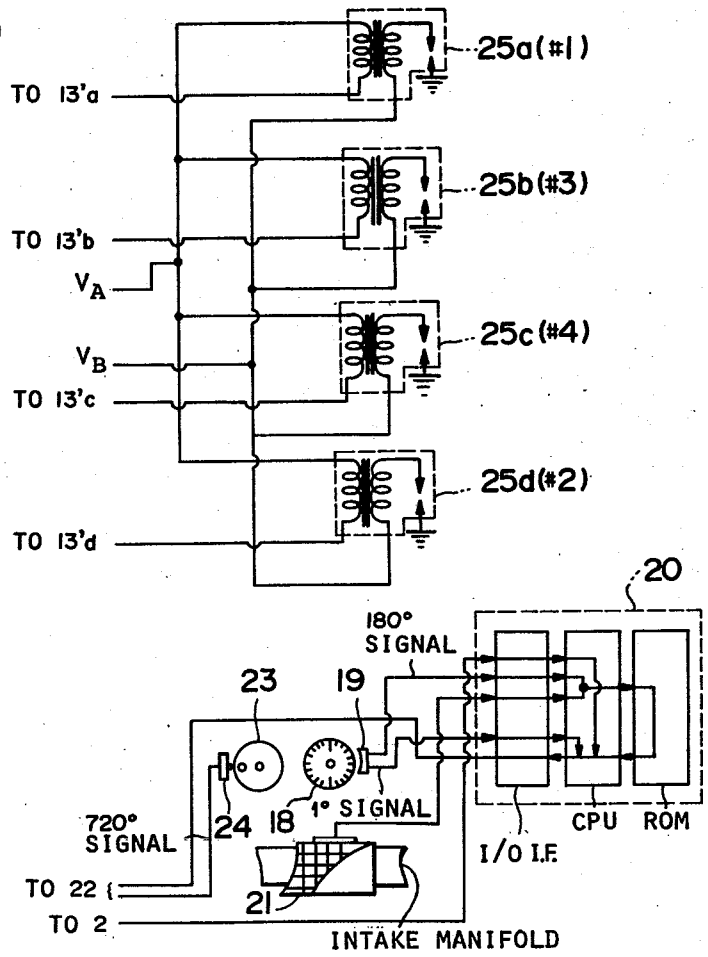

FIGS. 2(A) and 2(B) show a second preferred embodiment of the ignition system according to the present invention.

In this embodiment, the central cable 7, distributor 3, and high-tension cables 5 as shown in FIG. 1 are omitted in order to eliminate the electromagnetic noise normally generated by such elements. In addition, the structure of the ignition system becomes simpler. Each spark plug is integrated or combined with a corresponding ignition coil. Therefore, the ignition signal distribution is carried out by means of a plurality of thyristors 13' and cylinder number judging circuit 22 provided within the CDI ignition device 8' and comprising, e.g., a ring counter and monostable multivibrators.

It should be noted that another signal needs to be produced in order to reset the cylinder number judging circuit 22 whenever the engine completes one rotation cycle (720°). Another disk 23 which rotates half as fast as the engine and is provided with a single peripheral tooth and another signal generator 24 which detects the passage of the tooth and generates and outputs to the cylinder number judging circuit 22 a pulse signal whose period corresponds to 720° of crankshaft rotation. As the microcomputer 20 outputs ignition signals including ignition advance angle to the cylinder number judging circuit 22 after receiving the reset 720° signal, first a first ignition start signal having a predetermined pulsewidth is sent to a first thyristor 13'*a* associated with a first integrally shielded ignition coil and spark plug 25*a* corresponding to the first cylinder (#1), then a second ignition start signal is sent to a second thyristor 13'*b* associated with a second integrally shielded ignition coil and spark plug 25*b* corresponding to the third cylinder (#3), and so on. In the case of a four-cylinder engine, immediately after the fourth ignition start signal is sent to a fourth thyristor 13'*d* associated with a fourth integrally shielded ignition coil and spark plug 25*d* corresponding to the second cylinder (#2), the reset signal is sent to the cylinder number judging circuit 22. This ignition operation is carried out repeatedly in the cylinder ignition order of #1, #4, #3, and #2. In this embodiment, the spark discharge characteristics depend on a sustained arc discharge interval determined chiefly by the inductance of the secondary winding of each integrally shielded ignition coil and spark plug 25 and of the sustained arc discharging coil 17.

Figure 3:
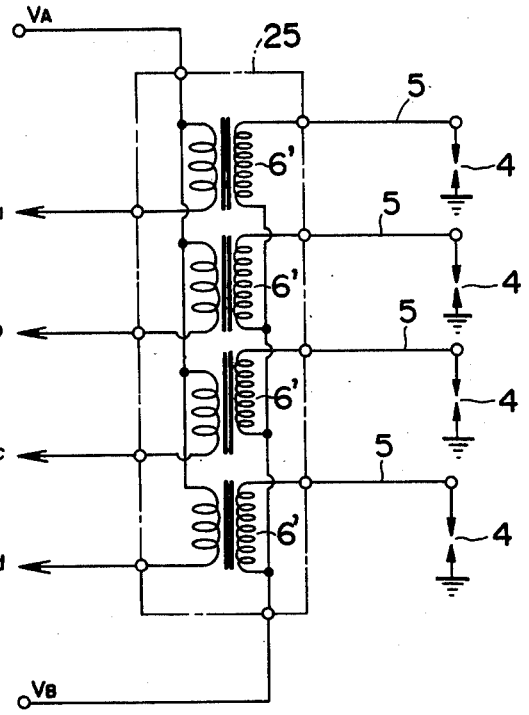
FIG. 3(A) is a circuit diagram particularly showing a plurality of spark plugs and composite ignition coils of a third preferred embodiment particularly applicable to a four-cylinder internal combustion engine.
FIG. 3(B) is a perspective view of a composite-type ignition coil shown in FIG. 3(A)
FIG. 3(C) is an enlarged cross-sectional view of the composite-type ignition coil.
Figure 3:
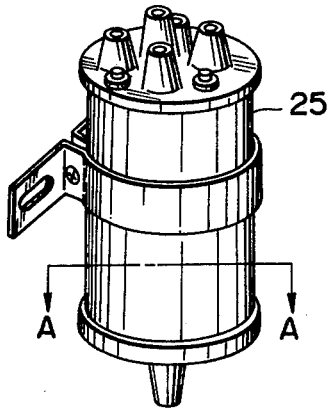
Figure 3:
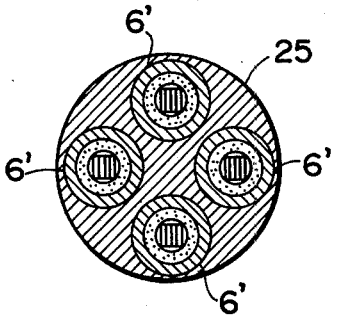

FIGS. 3(A), 3(B), and 3(C) show a third preferred embodiment of the ignition system according to the present invention.

FIG. 3(A) shows a plurality of spark plugs 4 and an ignition coil unit 25 comprising a plurality of ignition coils 6', one end of each secondary winding of which is connected to the corresponding spark plug 4 and the other end of each secondary winding of which is integrally connected to the second secondary winding 11 of the voltage boosting transformer in the CDI ignition device 8 (8') of FIG. 1 (or FIG. 2), one end of each primary winding of which is connected to the first secondary winding of CDI device 8 is and the other end of each primary winding of which is connected to an anode of the corresponding thyristor 13'*a* through 13'*d* shown in FIG. 2.

FIG. 3(B) shows a composite ignition coil unit 25 and FIG. 3(C) is a cross-sectional view of the composite ignition coil 25 taken along the line A—A. In this embodiment, the miniaturized ignition coils 6 as shown in FIG. 1 are integrally housed within a single molded housing or casing so as to integrate the wiring thereof. It should be noted that although high-tension cables 5 are also employed, as shown in FIG. 1, the ignition energy loss and ignition noise are minimized since the distributor 3 shown in FIG. 1 is not used.

Figure 4:
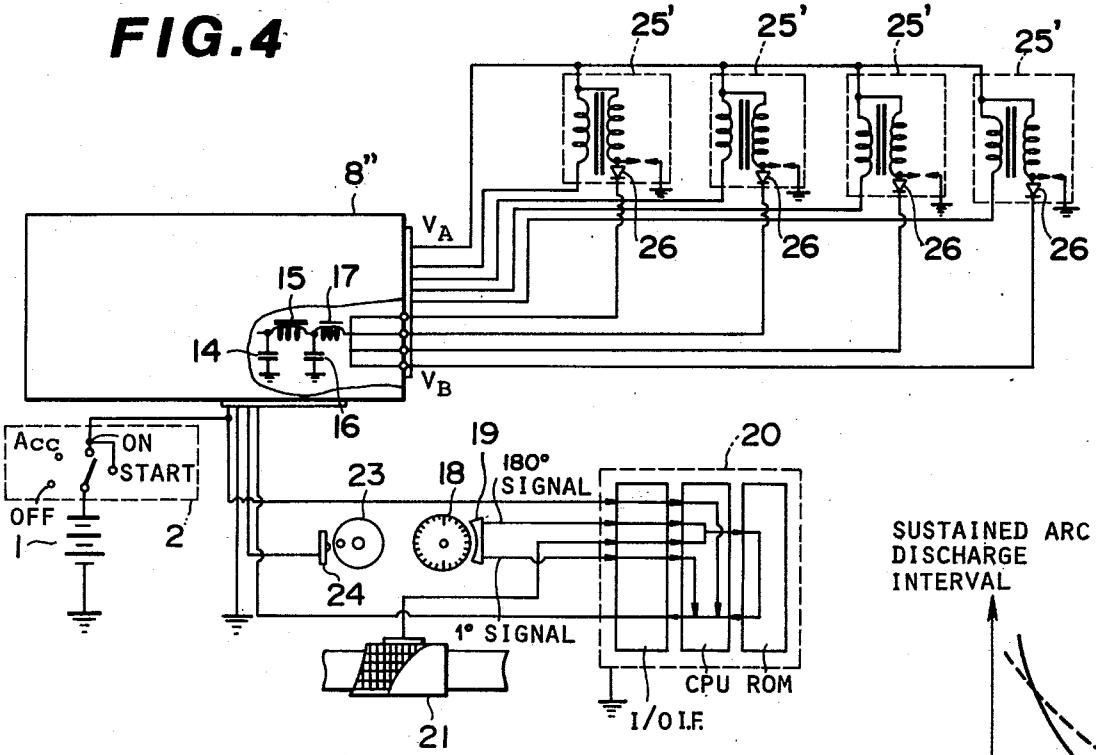
FIG. 4 is a circuit diagram showing a fourth preferred embodiment.

FIG. 4 shows a fourth preferred embodiment of the ignition system.

In this embodiment, the sustained arc discharge ignition energy is supplied via the diode 26 between the secondary winding of each ignition coil and the corresponding grounded spark plug 25'. Each diode 26 is provided in order to prevent leakage of high voltage at the time of spark discharge. The induction value required to sustain spark discharge is provided by including the discharge sustaining coil 17 within a discharge energy distributive CDI ignition device 8''. In this embodiment, the ignition system comprises two components, the discharge energy distributive CDI ignition device 8'' and combined ignition coil and spark plug blocks 25'. Therefore, the high-tension cables, the distributor, and the central cable are eliminated in order to minimize discharge energy loss and radio frequency noise. The insulation resistance between the electrodes of each spark plug increases when air-fuel mixture ignites and the pressure within the cylinder increases. The interval of time during which the sustained arc occurs in each ignition system shown in FIGS. 1, 2, 3, and 4 starts with the capacitive discharge (CDI) and ends with the generation of a sufficiently high restoring voltage as the resistance value within the cylinder increases. However, the interval of time changes depending on the engine operating conditions.

Figure 5:
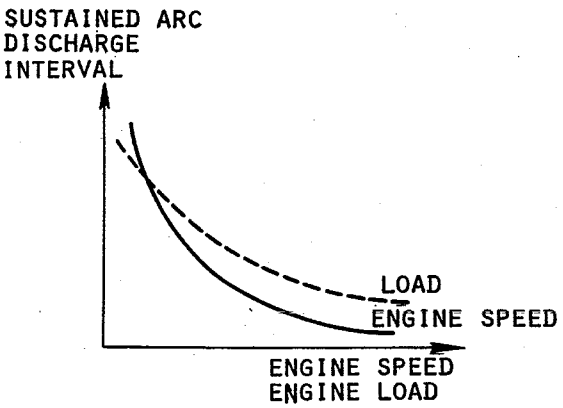
FIG. 5 is a graph of the relationship between discharge interval, engine revolutional speed, and engine load.

As shown in FIG. 5, the discharge interval of time is a function of the engine rotational speed and engine load.

As described hereinbefore, according to the present invention since the modification of the DC-DC converter incorporated in the CDI ignition device permits the DC-DC converter to supply arc-sustaining ignition energy into the secondary winding of the ignition coil, the high voltage can be applied into the primary winding of each ignition coil and each ignition coil can be integrally miniaturized. Consequently, the number of components can be reduced and ignition noise can be minimized. The combination of capacitive discharge and sustained-arc discharge of the CDI ignition device enables sufficient ignition energy even at high engine speeds. In addition, after the start of discharge by means of capacitive discharge (CDI), the ignition energy for sustaining arc is supplied to the secondary winding of each ignition coil so that misfire cannot occur and the expansion of an initial flame front is faster. Consequently, combustion at low fuel consumption rates can be achieved with certainty at times of low load and low engine speed. Therefore, the performance of the ignition system can conform to the internal combustion engine operating characteristics.

It will be clearly understood by those skilled in the art that modifications may be made in the preferred embodiments described hereinbefore without departing the spirit and scope of the present invention, which is to be defined by the appended claims.

What is claimed is:

1. An internal combustion engine ignition system, comprising:

(a) a DC-DC converting means having a voltage transformer which converts a low DC voltage into a corresponding AC voltage and boosts and rectifies the AC voltage into a first higher DC voltage for generating a spark discharge energy, boosts and rectifies the AC voltage into a second higher DC voltage for generating an arc-sustaining ignition energy, and rectifies the AC voltage into a third higher DC voltage;

(b) an ignition signal generating means which generates and outputs an ignition signal whenever the engine rotates through a predetermined engine rotational angle offset by an angle determined by the engine speed and engine load;

(c) an ignition coil means having a primary winding and secondary winding, one end of the primary winding thereof receiving the first DC voltage from said DC-DC converting means, the other end of the primary winding thereof being grounded when the ignition signal is received from said ignition signal generating means, one end of the secondary winding receiving the second DC voltage from said DC-DC converting means; and (d) a plurality of spark plugs each located within a corresponding cylinder and having a gap between electrodes thereof and one end thereof being connected to said DC-DC converting means for receiving the second and third DC voltages therefrom when the ignition signal is received by said ignition coil.

2. An internal combustion engine ignition system as set forth in claim 1, which further comprises a distributor having a rotor electrode connected to the other end of the secondary winding of said ignition coil via a central cable and a plurality of fixed electrodes, each connected to a corresponding spark plug via a high-tension cable, the rotor electrode rotating at a rate proportional to engine speed and being so disposed as to cyclically come into contact with each of the fixed electrodes in a predetermined order.

3. An internal combustion ignition system as set forth in claim 1, wherein said DC-DC converting means comprises a full-wave rectifier, an ignition energy charging capacitor connected to said full-wave rectifier for charging the full-wave rectified high DC voltage, a choke coil, an arc-sustaining capacitor, and another coil for setting the interval of time during which the arc discharge is sustained.

4. An internal combustion engine ignition system as set forth in claim 1, wherein said ignition coil means comprises a plurality of ignition coils, one end of each primary winding thereof receiving the first DC voltage from said DC-DC converting means the other end of each primary winding thereof being alternatingly grounded according to a predetermined ignition order, one end of each secondary winding thereof receiving the second DC voltage from said DC-DC converting means, and the other end of each secondary winding being connected to the corresponding spark plug.

5. An internal combustion engine ignition system as set forth in claim 4, wherein each ignition coil and the corresponding spark plug are connected by means of a high tension cable.

6. An internal combustion engine ignition system as set forth in claim 4, wherein the end of each secondary winding of the ignition coil connected to the corresponding spark plug is connected to said DC-DC converting means for receiving the second DC voltage via a diode for preventing leakage of the second DC voltage.

* * * * *

UNITED STATES PATENT AND TRADEMARK OFFICE

CERTIFICATE OF CORRECTION

PATENT NO. : 4,457,285

DATED : July 3, 1984

INVENTOR(S) : Kyugo HAMAI, Yasuhiko NAKAGAWA, Meroji NAKAI, Junichi FURUKAWA and Takashi ISHIZUKA It is certified that error appears in the above—identified patent and that said Letters Patent is hereby corrected as shown below:

IN THE BIBLIOGRAPHICAL DATA:

At item [75] first inventors first name should read -- Kyugo -- and second inventors first name should read -- Yasuhiko --.

Signed and Sealed this

*Fifth* Day of *March 1985*

[SEAL]

*Attest:*

DONALD J. QUIGG

*Attesting Officer* *Acting Commissioner of Patents and Trademarks*